United States Patent [19]

Nomura et al.

[11] Patent Number: 4,804,037

[45] Date of Patent: Feb. 14, 1989

[54] DUAL-ROLL TYPE CONTINUOUS CASTING MACHINE

[75] Inventors: Akihiro Nomura, Yokohama; Hisahiko Fukase, Meguro; Kunio Matsui, Yokohama; Atsushi Hirata, Hiratsuka, all of Japan

[73] Assignee: Ishikawajima-Harima Jukogyo Kabushiki Kaisha, Japan

[21] Appl. No.: 203,429

[22] Filed: Jun. 7, 1988

[30] Foreign Application Priority Data

Jun. 18, 1987 [JP] Japan ..... 62-152141

[51] Int. Cl.[4] ..... B22D 11/18; B22D 11/06

[52] U.S. Cl. ..... 164/449; 164/155; 164/428

[58] Field of Search ..... 164/453, 155, 449, 428, 164/480

[56] References Cited

U.S. PATENT DOCUMENTS 4,694,887 9/1987 Matsui et al. ..... 164/428

*Primary Examiner*—Kuang Y. Lin

[57] ABSTRACT

Flow rates of melt supplied to triple-point regions are controlled in response to detected shapes of lateral side surfaces of a casting and a level of the melt in a basin is maintained constant, whereby high-quality castings are produced.

1 Claim, 3 Drawing Sheets

DUAL-ROLL TYPE CONTINUOUS CASTING MACHINE

BACKGROUND OF THE INVENTION

The present invention relates to a dual-roll type continuous casting machine.

In a conventional dual roll type continuous casting machine as shown in FIG. 1, melt 4 is supplied to an upper space defined by two cooling rolls 2 and 3 which are disposed horizontally and in parallel with each other and which have side weirs 1 disposed on both sides of the cooling rolls 2 and 3, thereby forming a basin. The melt 4 is cooled by the cooling rolls 2 and 3 and a casting 5 is pulled out of a gap or nip between the cooling rolls 2 and 3.

Continuous casting by the above mentioned machine tends to involve a triple-point problem. More specifically, a solidified shell 7 grows integrally on cylindrical surfaces of the cooling rolls 2 and 3 and an inner surface of the side weir 1 at a triple-point 6 (i.e., the point of contact between the cooling rolls 2 and 3, the stationary side weir 1 and the melt 4) and is torn off due to rotation of the cooling rolls 2 and 3. As a result, lateral sides of the casting 5 may have defects 8 in various shapes so that the melt 4 which is still in the liquid state inside the casting 5 may flow to the exterior and the casting 5 may be broken.

Therefore, recently there has been used a system in which part of the melt 4 supplied to the basin is positively directed to the triple-point regions 6, whereby growth of the solidified shell on the side weirs 1 is prevented. Furthermore, flow rate of the melt 4 supplied to the basin is controlled in accordance with thickness of the casting 5 and the casting velocity so as to maintain constant the level H of the melt 4 in the basin.

When the flow rate of the melt 4 supplied to the triple-point region 6 is too high in the above-described system, the solidified shell on the cooling rolls 2 and 3 also melts and the lateral sides of the casting 5 have drop- or buldge-shaped run outs or defects 9. On the other hand, when the flow rate of the melt 4 supplied to the basin is too low, the above-described triple-point problem results. Variation of the flow rate of the melt supplied to the triple-point region 6 is due to variations of casting conditions such as variation in quantity of the melt in a tundish (not shown) as a supply of melt above the basin, variation in cross-sectional area of a melt supply passage due to adhesion of materials to the inner wall surface thereof and temperature variation of the melt.

Adjustment in flow rate of the melt supplied to the triple-point region 6 for overcoming the above-mentioned problems would involve variation in level H of the melt which in turn causes the displacement of the supplied position of the melt to the triple point region 6 for prevention of the triple point problem, resulting in above-mentioned defects 8 and 9 in shape.

Therefore, conventionally, adjustment for maintaining the level H of the melt is carried out without adjustment of the flow rate of the melt to the supplied triple-point region at all so that because of the above-described variations of casting conditions the lateral sides of the casting 5 may have defects 8 and 9 in shape, resulting in degradation in quality of the casting and increase of cost due to resultant difficulties of succeeding rolling or the like operations. Furthermore, with the level of the melt being maintained constant, the triple point problem still tends to frequently occur especially at the beginning of continuous casting because of reduction in cross-sectional area of the melt supply passage and consequent reduction in flow rate of the melt supplied to the basin, resulting in decrease of the yield of the casting.

The present invention was made to overcome the above and other problems encountered in the conventional dual roll type continuous casting machines and has for its object to control the flow rate of the melt supplied to the triple point regions in response to the shapes of the lateral side surfaces of the casting and to automatically maintain constant the level or height of the melt in the basin so that a high quality casting can be produced.

Now a preferred embodiment of the present invention will be described with reference to the accompanying drawings.

DETAILED DESCRIPTION OF THE PREFERRED EMBODIMENT

Figure 1:
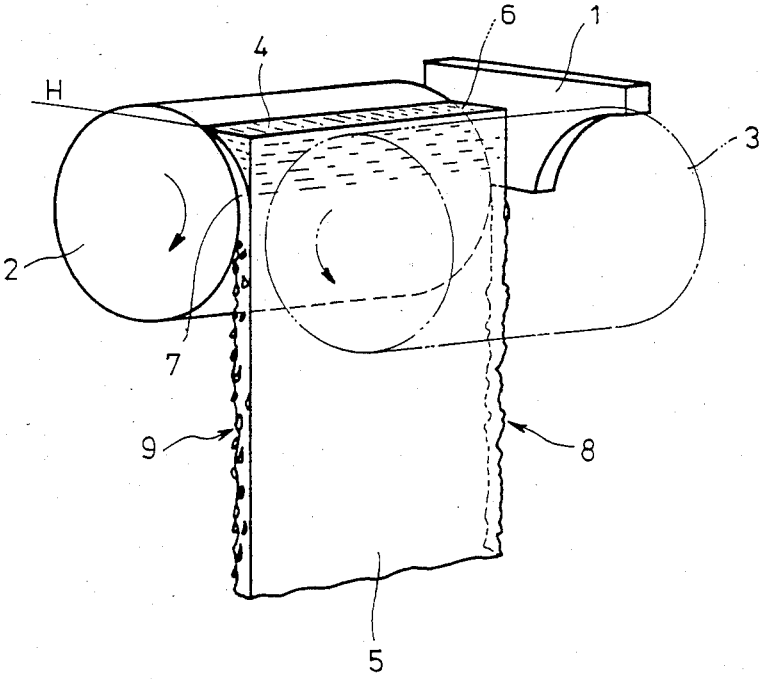
Fig. 1 PRIOR ART
FIG. 1 is a perspective view of a conventional dual roll type continuous casting machine used to explain the problems thereof.
Figure 2:
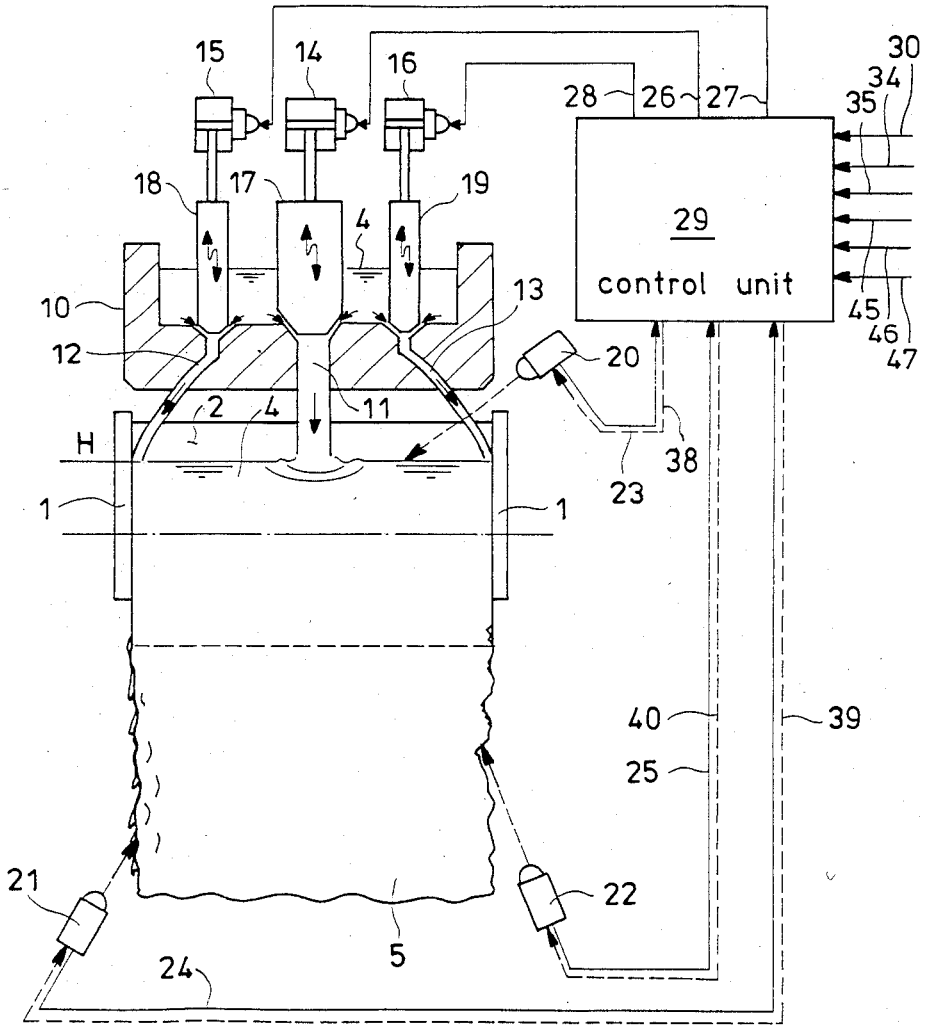
FIG. 2 is a view used to explain a preferred embodiment of the present invention.

FIG. 2 shows one embodiment of the present invention. A tundish 10 for supplying melt 4 over the cooling rolls 2 and 3 as shown in FIG. 1 is formed with a main passage 11 centrally in the widthwise direction of the tundish 10 and side passages 12 and 13 for supplying the melt 4 to the triple point regions 6 on either side. A flow rate controller for controlling the flow rates of the melt 4 passing through the main and side passages 11, 12 and 13 comprises actuators 14, 15 and 16 which are respectively adapted to vertically displace control members 17, 18 and 19 independently of each other.

Further provided are a liquid level sensor 20 for detecting the level H of the melt 4 in the basin formed over the cooling rolls 2 and 3 and shape sensors 21 and 22 for respectively detecting shapes of the lateral side surfaces of the casting 5. Furthermore, a control unit 29 is provided to receive output signals from the sensors 20, 21 and 22 and to deliver control signals 26, 27 and 28 to the actuators 14, 15 and 16, respectively.

Figure 3:
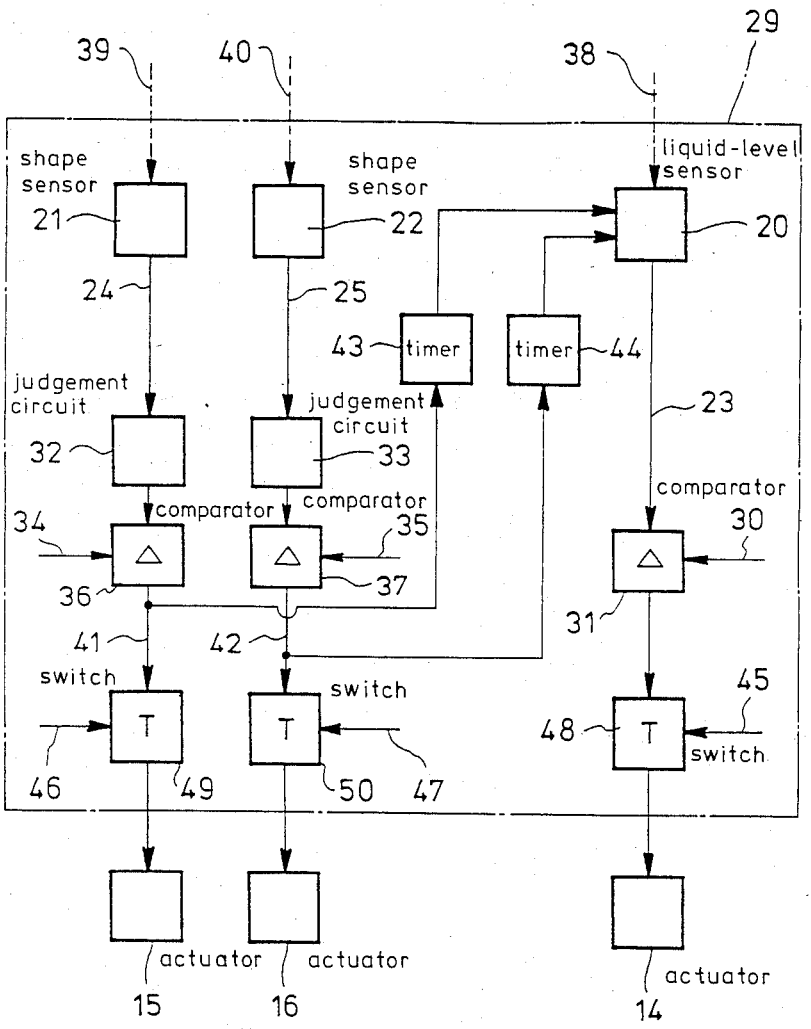
FIG. 3 is a diagram of a control circuit for a control unit shown in FIG. 2.

FIG. 3 shows a block diagram of a control circuit for the control unit 29. The output signal from the liquid-level sensor 20 is delivered to a comparator 31 to which a level-setting signal 30 is applied and is compared with the latter signal 30. Therefore, the actuator 14 is so actuated as to adjust the vertical position of the control member 17 to control the flow rate of the melt 4 flowing through the main passage 11 so that the level H of the melt 4 is maintained at a predetermined level.

The output signals 24 and 25 from the shape sensors 21 and 22 are respectively delivered to judgement circuits 32 and 33 so that the shapes of the side surfaces of the casting 5 are judged. Outputs from the judgement circuits 32 and 33 are respectively delivered to comparators 36 and 37 to which shape setting signals 34 and 35 are applied and are compared with the latter signals 34 and 35 so that the actuators 15 and 16 are adjusted to respectively control the flow rates of the melt 4 flowing through the side passages 12 and 13 to thereby maintain the side surfaces of the casting 5 in a predetermined shape.

The detections by the sensors 20, 21 and 22 and the adjustments in response to the output signals therefrom may be carried out all the time; alternatively, they may be effected periodically, arbitrarily, simultaneously or individually in response to command signals 38, 39 and 40.

When at least one of the shape sensors 21 and 22 detects the shape of the corresponding side surface of the casting 5 and the corresponding actuator 15 or 16 is adjusted, the liquid level sensor 20 is actuated through timer 43 or 44 in response to adjustment signal 41 or 42 from the comparator 34 or 35 so that the level of the melt 4 is automatically controlled.

Switches 48, 49 and 50 to which initial settings 45, 46 and 47 are respectively applied respectively connect the comparators 31, 36 and 37 with the actuators 14, 15 and 16.

When the comparator 31 detects any difference between the output signal from the liquid-level sensor 20 and the level-setting signal 30, the actuator 14 is actuated to adjust the flow rate of the melt 4 flowing through the main passage 11 so as to maintain the level of the melt 4 at a predetermined setting level (the level H of the melt).

The shape sensors 21 and 22 detect the shapes of the side surfaces of the casting 5 and respectively deliver their output signals 24 and 25 to the judgement circuits 32 and 33 and the output signals representative of the shapes of the side surfaces of the casting 5 from the judgement circuits 32 and 33 are respectively compared with the shape-setting signals 34 and 35 applied to the comparators 36 and 37. When there exists any difference between the output signals from the judgement circuits 32 and 33 and the shape-setting signals 34 and 35, the actuators 15 and 16 are actuated to change the flow rates of the melt 4 flowing through the side passages 12 and 13 so that the defects 8 and 9 in shape of the side surfaces of the casting 5 are avoided.

Change of the flow rates of the melt 4 flowing through the side passages 12 and 13 may cause change of the level H of the melt 4; however, according to the present invention, in response to the adjustment signal 41 or 42, the liquid level sensor 20 is actuated after a predetermined time delay determined by the timer 43 or 44 to adjust the liquid level of the melt 4 so that the level H of the melt is automatically maintained constant.

At the beginning of the continuous casting, the temperatures of the tundish 10 and other parts are not sufficiently high so that the solidified shell adheres to the inner surfaces of the passages 11, 12 and 13 and the cross-sectional areas of the passages are decreased, resulting in failure of satisfactory control. In order to solve this problem, the switches 48, 49 and 50 are so actuated at the beginning of the continuous casting as to control the actuators 14, 15 and 16 in accordance with initial settings 45, 46 and 47. As a result, the initial stage of the continuous casting can be stabilized and the yield can be enhanced.

According to the above-described embodiment, in response to the detected shapes of the lateral side surfaces of the casting 5, the flow rates of the melt flowing through the side passages 12 and 13 are adjusted preferentially and possible variations in the level H of the melt 4 are absorbed by adjusting the flow rate of the melt flowing through the main passage 11 so that the height H is maintained at a predetermined level. As a result, the effect of the melt 4 supplied to the triple-point regions 6 is enhanced and high-quality castings 5 free from defects 8 and 9 in shape can be obtained in a stable manner.

It is to be understood that the present invention is not limited to the above-described embodiment and that various modifications may be made within the scope of the present invention. For instance, various types of actuators and adjustment members may be used; two or more main passages may be used; and the shapes of the side passages may be varied as needs demand.

As described above, according to the dual-roll type continuous casting machine in accordance with the present invention, the casting having a satisfactory shape can be continuously produced by automatically adjusting the flow rates of the melt supplied to the triple-point regions in response to the detected shapes of the lateral side surfaces of the casting and the effects of the melt supplied to the triple point region can be stabilized by adjusting the flow rate of the melt flowing through the main passage so as to adjust the height of the level of the melt in the basin.

What is claimed is:

1. A dual roll type continuous casting machine comprising two cooling rolls having side weirs, a basin defined by said cooling rolls and side weirs, a tundish disposed above said basin and having a main passage and side passages, said side passages being directed to supply melt to opposite triple point regions in said basin, flow rate control means for controlling flow rates of melt flowing through said main and side passages independently of each other, level sensor means for sensing level of the melt in said basin, shape sensor means for sensing shapes of lateral side surfaces of a casting and a control unit for controlling said flow rate control means at the side passages in response to detection outputs from said shape sensor means and controlling said flow rate control means at the main passage in response to a detection output from said level sensor means.

* * * * *